US011766806B2

(12) United States Patent
Svensson et al.

(10) Patent No.: US 11,766,806 B2
(45) Date of Patent: Sep. 26, 2023

(54) METHOD OF JOINING A NOGGING TO A STUD TO FORM A SUB-MODULE OF A PREFABRICATED BUILDING MODULE AND USE OF SUCH METHOD

(71) Applicant: Nordiska Truss AB, Falkenberg (SE)

(72) Inventors: Åke Svensson, Falkenberg (SE); Daniel Bäckström, Falkenberg (SE)

(73) Assignee: Nordiska Truss AB, Falkenberg (SE)

( * ) Notice: Subject to any disclaimer, the term of this patent is extended or adjusted under 35 U.S.C. 154(b) by 325 days.

(21) Appl. No.: 17/266,321

(22) PCT Filed: Jul. 12, 2019

(86) PCT No.: PCT/EP2019/068811

§ 371 (c)(1),
(2) Date: Feb. 5, 2021

(87) PCT Pub. No.: WO2020/035237

PCT Pub. Date: Feb. 20, 2020

(65) Prior Publication Data

US 2021/0316472 A1 Oct. 14, 2021

(30) Foreign Application Priority Data

Aug. 14, 2018 (SE) ..... 1850977-8

(51) Int. Cl.
*B27M 1/08* (2006.01)
*B27M 3/00* (2006.01)
(Continued)

(52) U.S. Cl.
CPC ..... *B27M 3/0073* (2013.01); *B27M 1/08* (2013.01); *E04B 2/704* (2013.01); *B27F 7/02* (2013.01)

(58) Field of Classification Search
CPC .... B27M 1/08; B27M 3/0013; B27M 3/0026; B27M 3/004; B27M 3/0073
See application file for complete search history.

(56) References Cited

U.S. PATENT DOCUMENTS 6,763,567 B2 * 7/2004 Smith ..... B27M 3/0073 29/430
2008/0172983 A1 * 7/2008 Urmson ..... B27M 1/08 52/745.19
2008/0251563 A1 * 10/2008 Young ..... B27F 7/006 227/152

FOREIGN PATENT DOCUMENTS

AU 551689 B2 5/1981
FR 2 951 975 A1 5/2011
(Continued)

OTHER PUBLICATIONS

International Search Report and Written Opinion dated Oct. 30, 2019, issued in International Patent Application No. PCT/EP2019/068811, filed Jul. 12, 2019, 10 pages.
(Continued)

*Primary Examiner* — Matthew Katcoff
(74) *Attorney, Agent, or Firm* — CHRISTENSEN O'CONNOR JOHNSON KINDNESS PLLC

(57) ABSTRACT

The invention refers to a method of joining a nogging to a stud to form a sub-module of a prefabricated building module. The method comprises the acts of: providing (1000) a stud (2) and orienting the stud with a longitudinal extension of the stud along a first direction (A); providing (2000) a nogging material having a longitudinal extension being greater than an intended length of the nogging, and orienting the nogging material with a longitudinal extension along a second direction (B) being transverse to the first direction (A); moving (3000) a first free end of the nogging material into abutment with a first side surface of the stud (2) and
(Continued)

cutting the nogging material to form a first nogging (3*a*); fixating (5000) and joining the free end of the nogging (3*a*) with the stud (2); moving (6000) the stud (2) and the first nogging (3*a*) along the first direction (A); and moving (7000) the free end of the nogging material into abutment with the stud (2); cutting (8000) the nogging material at a distance from the abutment, thereby forming a second nogging (3*b*); and fixating (9000) and joining the stud (2) and the second nogging (3*b*).

6 Claims, 8 Drawing Sheets

(51) Int. Cl.
*E04B 2/70* (2006.01)
*B27F 7/02* (2006.01)

(56) References Cited

FOREIGN PATENT DOCUMENTS

| | | | |
|---|---|---|---|
| GB | 2 305 629 | B | 4/1997 |
| JP | 2963297 | B2 | 10/1999 |
| NZ | 199581 | A | 5/1985 |
| WO | 84/02677 | A1 | 7/1984 |

OTHER PUBLICATIONS

Swedish Search Report dated Jan. 30, 2019, issued in Swedish Application No. 1850977-8, filed Aug. 14, 2018, 3 pages.

* cited by examiner

METHOD OF JOINING A NOGGING TO A STUD TO FORM A SUB-MODULE OF A PREFABRICATED BUILDING MODULE AND USE OF SUCH METHOD

TECHNICAL FIELD

The present invention refers to a method of joining a nogging to a stud to form a sub-module of a prefabricated building module, and also the use of such method to form a prefabricated building module.

TECHNICAL BACKGROUND

It is well known in the art to provide prefabricated housings where a plurality of prefabricated modules are manufactured in a factory and then shipped to a building site where they are assembled to form a housing. Examples of modules are wall frames, floors and roof trusses. The modules are typically produced in high speed production lines.

In the case of a frame wall, this comprises a framework made up by one or more vertical studs which are interconnected by one or more horizontal noggings. Further head and ground beams are arranged in the upper and lower free ends of the studs, thereby forming the framework. The cavities formed between the studs, the noggings and the head and ground beams are provided with components such as insulation panels, cables and pipes for electricity, water, heating and sanitation and then covered with boards before ultimately being provided with a decorative surface layer.

The cross sectional dimensions of the studs and noggings are typically provided in standardized assorted ranges. This also applies to other components such as boards, panels and insulation material to be contained in the frame wall. Thus, the position of the studs and the noggings are typically arranged at a predetermined distance from each other to fit the other components. Other decisive parameters are the positions of any doors and windows. The number and position of noggings may also be adapted to the intended use of the wall. One example is if the frame wall should form part of a bearing wall. Another example is if the frame wall should form part of a wall to be used for supporting cupboards or the like, whereby the noggings should be arranged at pre-determined heights.

Accordingly, in the case of a production line that is configured to produce prefabricated modules, it is essential that a production line has a certain degree of flexibility allowing easy and quick adaption to the type of frame wall to be produced. This is typically made by providing pallets with input raw material for noggings and studs having pre-cut lengths and predetermined standardized cross sections. These are either manually or automatically fed to a fixture where the parts are fixated to each other by fixing means such as nails.

Since a production plant should allow a certain degree of flexibility, a plurality of pallets with different dimensions in terms of cross sectional dimensions and pre-cut lengths must be readily accessible. This requires a substantial number of stock articles, available storage place and not at least a logistic system which allows easy transportation to and from the production line. This increases the overall production cost and hence the price on the product. There is hence a need for a more cost efficient solution which reduces costs for storage and transport of raw material to the production line.

SUMMARY

One object of the present invention is to provide a method that allows an automatized handling of noggings and studs to be included in a frame wall to be produced.

Another object is to provide a method that allows the use of overlong raw material and overlong raw material of different lengths.

Yet another object is to allow the method to be used in a high-speed production line for production of sub-modules to be used in prefabricated building modules.

These and other objects are solved by a method of joining a nogging to a stud to form a sub-module of a prefabricated building module, the method comprising the steps of: providing a stud and orienting the stud with a longitudinal extension of the stud along a first direction; providing a nogging material having a longitudinal extension being greater than an intended length of the nogging, and orienting the nogging material with a longitudinal extension along a second direction being transverse to the first direction; moving a first free end of the nogging material into abutment with a first side surface of the stud; cutting the nogging material at a distance from the abutment, thereby forming a first nogging having an intended length; fixating the stud and the first nogging and joining the free end of the nogging with the side surface of the stud by inserting a fixing member from a second side surface of the stud, the second side surface being opposite the first side surface; moving the stud and the first nogging along the first direction; and moving the free end of the nogging material into abutment with the first side surface of the stud; cutting the nogging material at a distance from the abutment, thereby forming a second nogging having the intended length; fixating the stud and the second nogging and joining the free end of the second nogging with the side surface of the stud by inserting a second fixing member from the second side surface of the stud.

By the present method, a highly automatized manufacturing of a sub-module comprising a stud with one or more noggings fixed thereto is provided. Each sub-module produced comprises a stud and one or more noggings fixed to the stud, where the stud and the respective nogging(s) each have a pre-determined length designed to fit a frame wall to be produced, and where the respective nogging(s) is joined to the stud in a pre-determined position along the longitudinal extension of the stud. Since the respective nogging(s) are continuously provided from an overlong piece of nogging material, there is no need to provide and handle individual noggings having a length which is tailor-cut to the sub-module to be produced. Thereby the logistics in the factory may be substantially simplified with less stock articles. This allows a reduced storage area but also a reduced footprint of the machinery. Further, the machinery may be substantially simplified and the production speed may be increased. Thereby the overall product cost may be reduced.

The method may further comprise the steps of determining the remaining length of the nogging material, and if determined to be smaller than the intended length of the nogging to be cut, removing the nogging material. The removed nogging material is preferably supplied to a conveyor for recycling while being replaced with a new piece of overlong nogging material.

The free end of the nogging material may be clean-cut before moving the free end of the nogging material into abutment with the first side surface of the stud. The cutting may be made by using a circular saw. The clean-cutting ensures a perpendicular and close abutment between the resulting free edge of the nogging and the stud.

The stud may be provided with a predetermined length and with its opposing free ends clean-cut. The stud may be provided as a single stud member or as two or more stud members forming a quadrangular, rectangular, L- or U-shaped cross section.

The nogging material may be supported and moved along the second direction by a gripper engaging a second free end of the nogging material. The gripper may be provided by e.g. hydraulically, pneumatically, or magnetically operated jaws. The gripper is preferably arranged to maintain its gripping engagement as long as the remaining length of the nogging material is determined to be greater than the intended length of the nogging to be cut.

At least one of the steps of: moving the stud and the first nogging along the first direction thereby providing a mutual distance between the first and the second noggings; and forming the first and the second noggings respectively with an intended length may be performed based on geometrical input data provided from a CAD model representing a building module in which the sub-module comprising the stud and the first and the second noggings are forming parts. The geometrical input data may be transferred to a control unit with a processor configured to control the method. Accordingly, by the control unit being configured to act based on geometrical data from a CAD-model, the setting of the machinery to switch from the production of one type of sub-module to another type of sub-module may be substantially facilitated since all geometrical data in terms of lengths and positions of the parts in the sub-module is readily accessible.

According to another aspect, the invention refers to the use of a method according to any of claims 1-6 to form a sub-module of a prefabricated building module.

Further objects and advantages of the present invention will be obvious to a person skilled in the art reading the detailed description given below describing one embodiment of the machinery and the method.

BRIEF DESCRIPTION OF THE DRAWINGS

The invention will be described in detail with reference to the schematic drawings.

DETAILED DESCRIPTION

In the following description a number of terms will be used. Unless nothing else is said, the terms are to be understood as follows:

The term "stud" is to be understood as a piece of wood forming a pillar in a frame wall. The stud typically has a vertical extension in a finished wall. The stud may have a quadrangular or rectangular cross section formed by one or more stud members. Alternatively, the stud may be formed by two or more stud members which are joined to form e.g. an L- or U-shaped cross section.

The term "nogging" is to be understood as a piece of wood fixed to a stud in a frame wall to strengthen the frame wall. The nogging is typically perpendicularly fixed to a stud by one or more nails. The nogging thereby typically has a horizontal extension in a finished wall.

The term "nogging material" is to be understood as a piece of wood having a standardized cross sectional dimension and an overlength, and which is to be cut into an intended length to fit in the frame wall to be produced. Thus, the overlong nogging material is cut into noggings.

Figure 1:
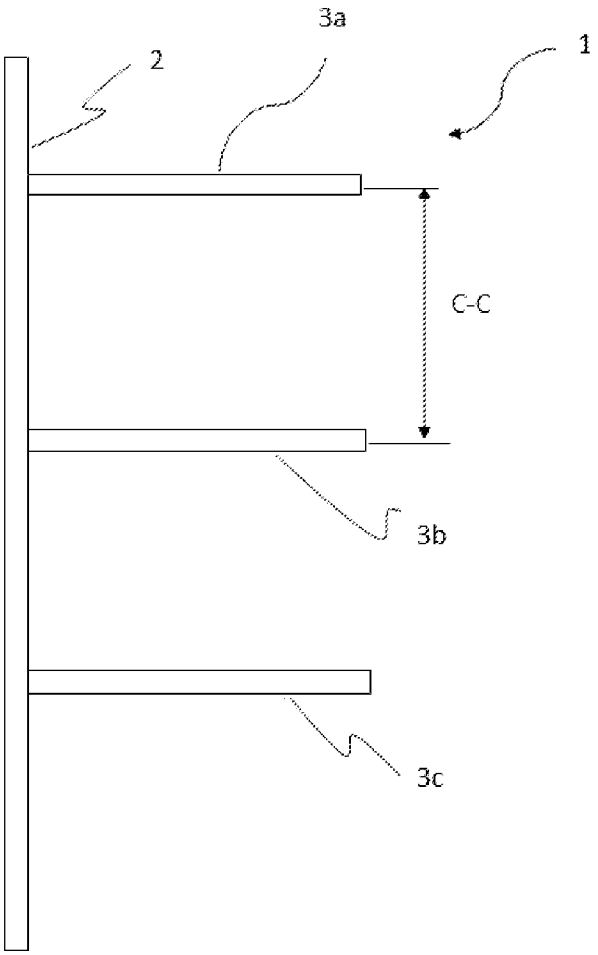
FIG. 1 discloses highly schematically one embodiment of a sub-module of a prefabricated building module comprising a stud with three noggings joined thereto.

Starting with FIG. 1 one example of a sub-module 1 of a prefabricated building module is disclosed highly schematically. The sub-module 1 comprises a stud 2 having a longitudinal extension. The stud 2 supports three noggings 3*a*-3*c* which are joined with one of their free ends to a longitudinal side surface of the stud 2. The joining is typically made by one of more fixing member such as nails or screws (not shown). The noggings 3*a*-3*c* are joined to the stud 2 with a mutual distance along the longitudinal extension of the stud. The distance C-C between the noggings 3*a*-3*c* is typically referred to as "center distance". That term will also be used in the description to follow. The distance is typically more or less standardized to fit components (not disclosed) such as boards, panels and insulation material later to be contained in or to be mounted to the frame wall. Other decisive parameters are the positions of any doors and windows (not disclosed) and the intended use of the wall.

The stud 2 may have a quadrangular or rectangular cross section. It is to be understood that the stud 2, although not disclosed, may be formed by more than one stud member. The stud may by way of example be provided by two or more stud members forming a quadrangular, rectangular, L- or U-shaped cross section.

Figure 2:
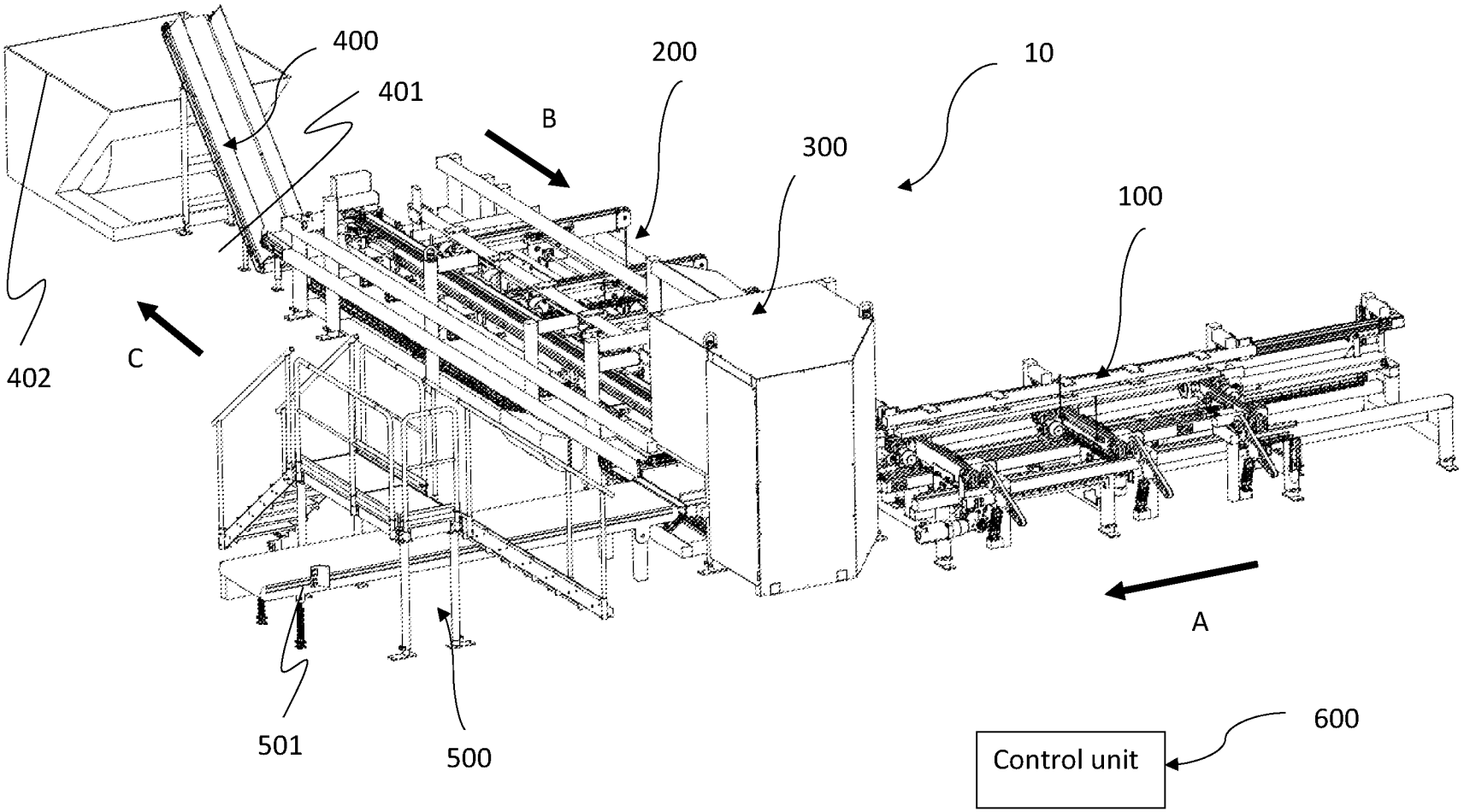
FIG. 2 discloses a general overview of a machinery system configured to be used for joining a nogging to a stud to form a sub-module of a prefabricated building module.

Now turning to FIG. 2, a general overview of a machinery system 10 is disclosed for joining a nogging 3*a*-3*c* to a stud 2 to thereby form a sub-module 1. The system 10 can be divided into a stud handling section 100 configured to handle studs, a nogging material handling section 200 configured to handle overlong pieces of flogging material, a cutting and fixation section 300 in which the overlong pieces of nogging material is cut to form a nogging 3*a*-3*c* having a pre-determined length and in which the nogging 3*a*-3*c* is fixated to the stud 2, a waste handling section 400 and a sub-module handling section 500.

The stud handling section 100 and the sub-module handling section 500 do each have an extension and feeding direction along a first direction, arrow A. The nogging material handling section 200 has an extension and feeding direction along a second direction, arrow B being transverse to the first direction A. The stud handling section 100 and the nogging material handling section 200 meet in the cutting and fixation section 300. The first and second directions A, B preferably extend in the horizontal plane. The waste handling section 400 has an extension and feeding direction along arrow C in a direction opposite the second direction B.

The operation of the system 10 is controlled by a control unit 600 comprising a processor and a memory. The control unit 600 is configured to operate based on signals from a plurality of sensors (not shown) distributed across the system 10. The control unit 600 may be configured to receive and process information relating to geometrical input data provided from a CAD model representing a building module in which the sub-module 1 to be produced is intended to form part. Thereby all measures relating to the stud 2 and noggings 3*a*-3*c* may be compiled automatically from the CAD-model to provide automatized setting of the system 10 and its moving parts.

Figure 3:
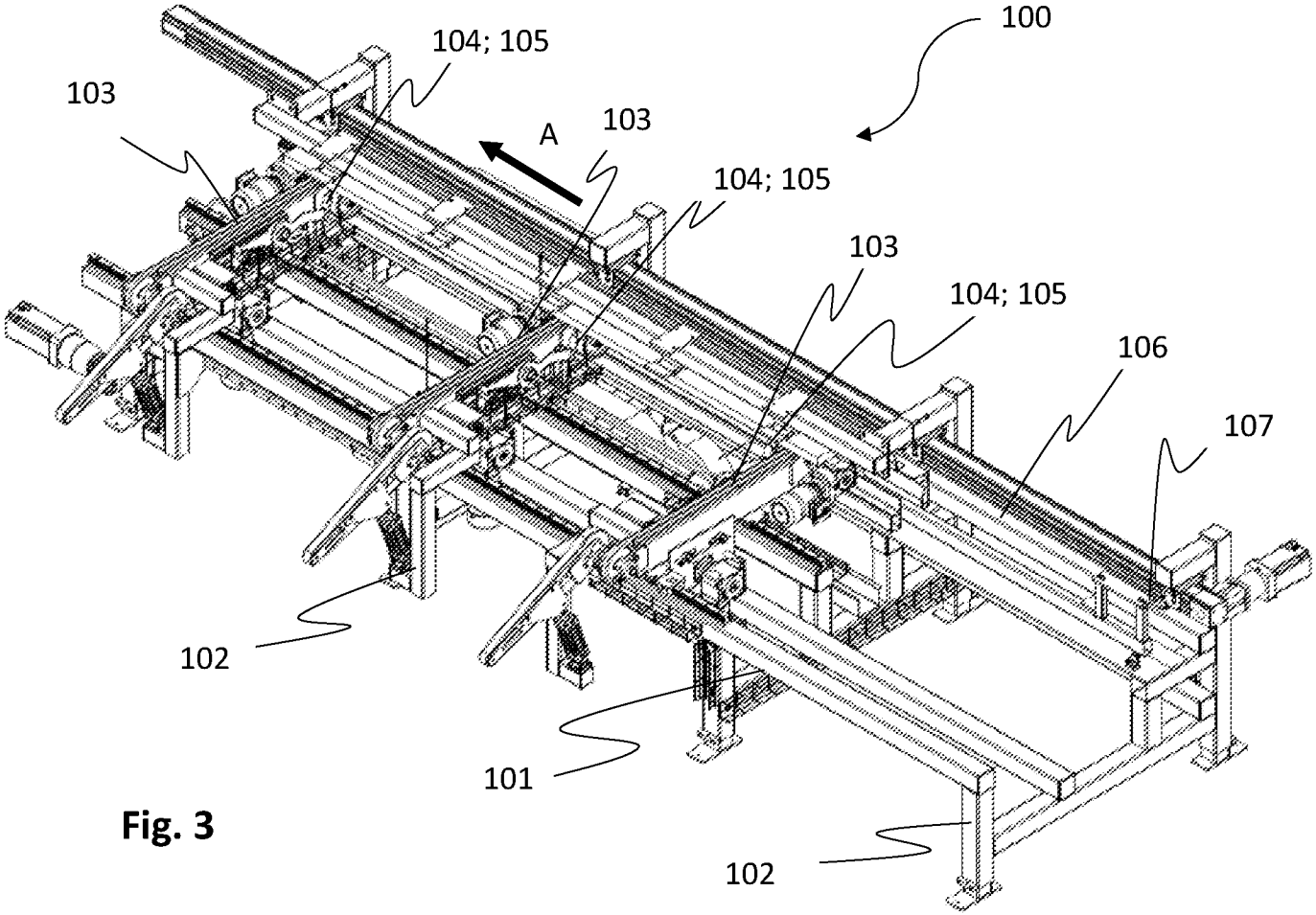
FIG. 3 discloses one embodiment of a stud handling section.

Now turning to FIG. 3, a perspective view of the stud handling section 100 is disclosed. The stud handling section 100 may be seen as a buffer of pre-cut studs (not shown) which are to be fed one at the time to the cutting and fixation section 300. The stud handling section 100 comprises a frame 101 supported by a plurality of legs 102. The frame 101 has a longitudinal extension along the first direction A. The frame 101 supports three sub-conveyors 103, each having an extension transverse to the first direction A. The number of sub-conveyors 103 may be altered with remained function.

In operation a plurality of studs (not disclosed), each having a pre-cut length, is configured to be arranged side by side with their longitudinal extensions extending in parallel with the first direction A transverse the extensions of the sub-conveyors 103. The studs are preferably arranged in one and the same crowning orientation. A stopper arrangement 104 may be arranged in the front end of the sub-conveyors 103 to control the feeding of studs on the sub-conveyors 103. The stopper arrangement 104 comprises in the disclosed embodiment a plurality of fingers 105 engaging a longitudinal side portion of a leading stud. By moving the fingers 105 up and down, one stud at the time will be allowed to leave the sub-conveyors 103 and fall to a skid rail 106 extending in the first direction A. The skid rail 106 is configured to guide and support one stud at a time towards the cutting and fixation section 300. As a stud has been supplied to the skid rail 106, the free end facing away from the cutting and fixation section 300, is engaged by a carrier 107 which is configured to abut and push the stud 2 along the skid rail 106 towards the cutting and fixation section 300. The carrier 107 is configured to displace the stud along the skid rail 106 to such extent that the intended position of a first nogging 3*a* to be joined to the stud is aligned with the longitudinal centerline of an overlong piece of nogging material to be supplied on the skid rail 206 of the nogging material handling section 200 to be discussed below. The displacement of the carrier 107 along the skid rail 106 may be controlled by the processor of the control unit 600.

Figure 4:
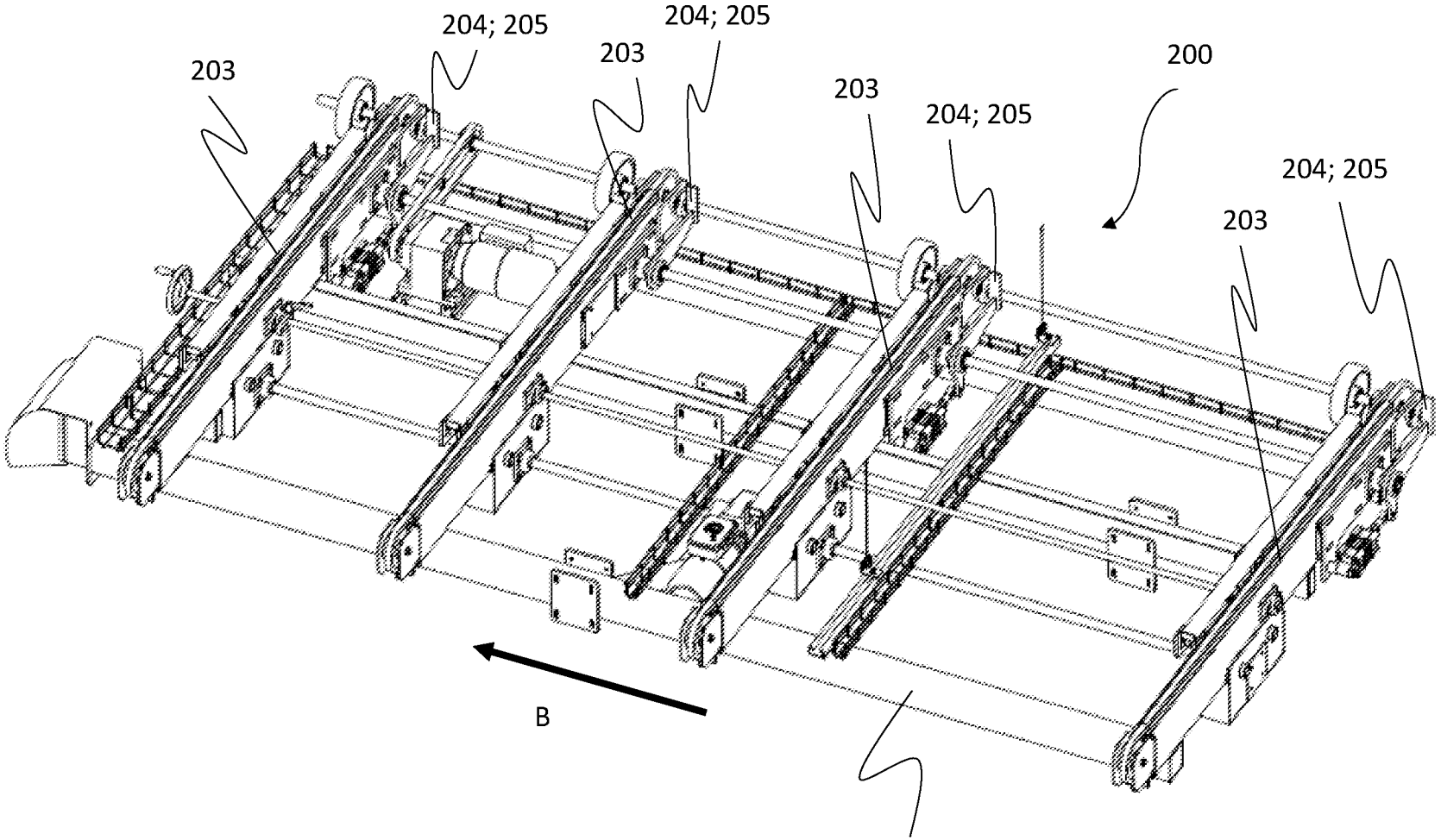
FIG. 4 discloses a perspective view of a part of one embodiment of a nogging material handling section.

Now turning to FIG. 4, a perspective view of a part of the nogging material handling section 200 is disclosed. The nogging material handling section 200 may be seen as a buffer of sorted or unsorted overlong nogging material (not shown) to be fed one at the time to the cutting and fixation section 300.

The disclosed part of the nogging material handling section 200 comprises a frame 201 The frame 201 has a longitudinal extension along the second direction B. The frame 201 supports four sub-conveyors 203, each having an extension transverse to the second direction B. The number of sub-conveyors 203 may be altered with remained function.

In operation a plurality of overlong pieces of nogging material (not disclosed), are configured to be arranged side by side with their longitudinal extensions extending transverse the extensions of the sub-conveyors 203. A stopper arrangement 204 is arranged in the front end of the sub-conveyors 203 to control the feeding of nogging materials on the sub-conveyors 203. The stopper arrangement 204 comprises fingers 205 configured to engage a longitudinal side portion of a leading stud. By moving the fingers 205 up and down, one piece of nogging material at the time will be allowed to leave the sub-conveyors 203 and be received by a skid rail 206 to be described below with reference to FIG. 5. The skid rail 206 is configured to guide and support one piece of overlong nogging material at a time towards the cutting and fixation section 300.

Figure 5:
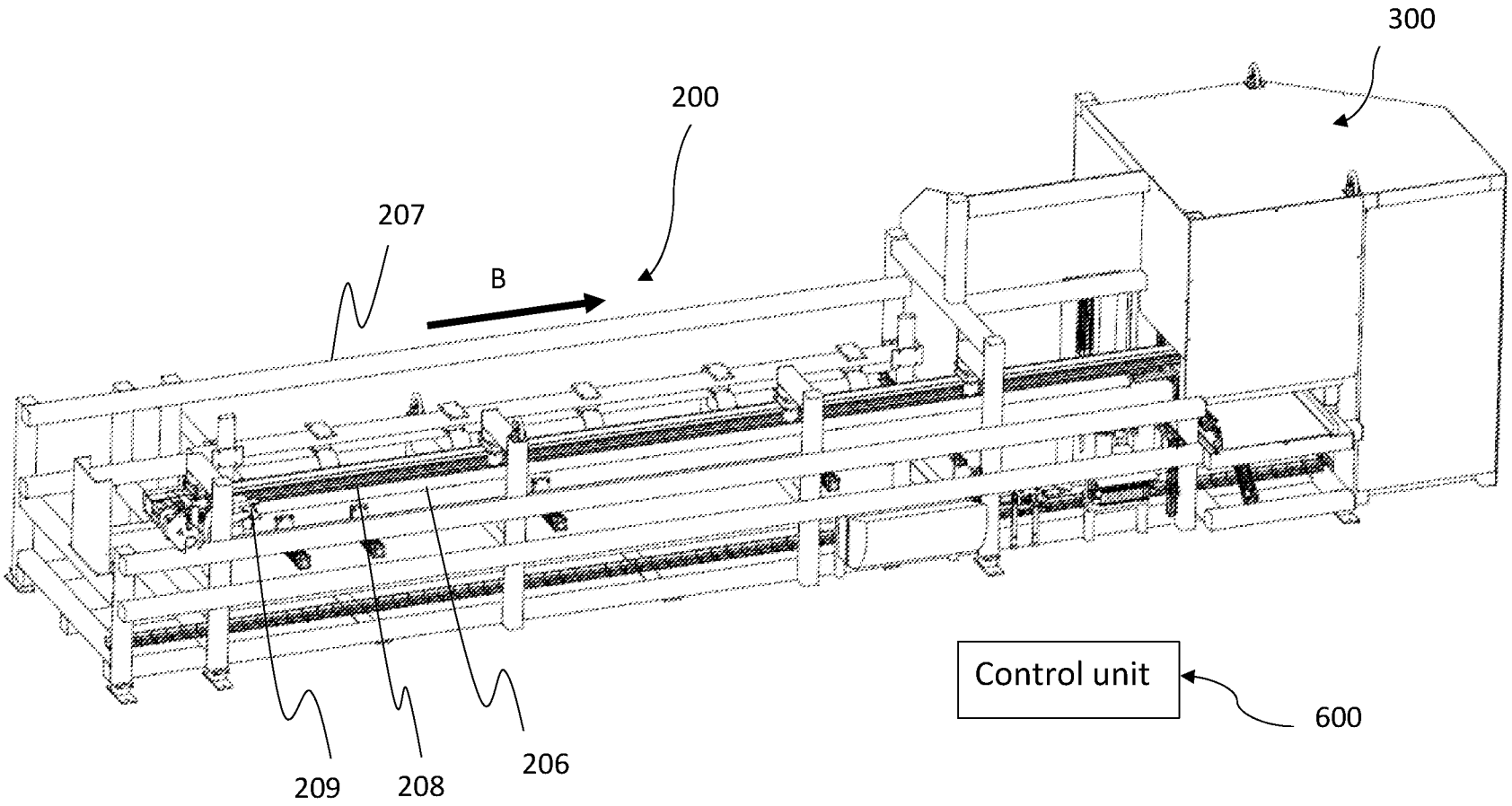
FIG. 5 discloses a perspective view of the nogging material handling section.
Figure 6:
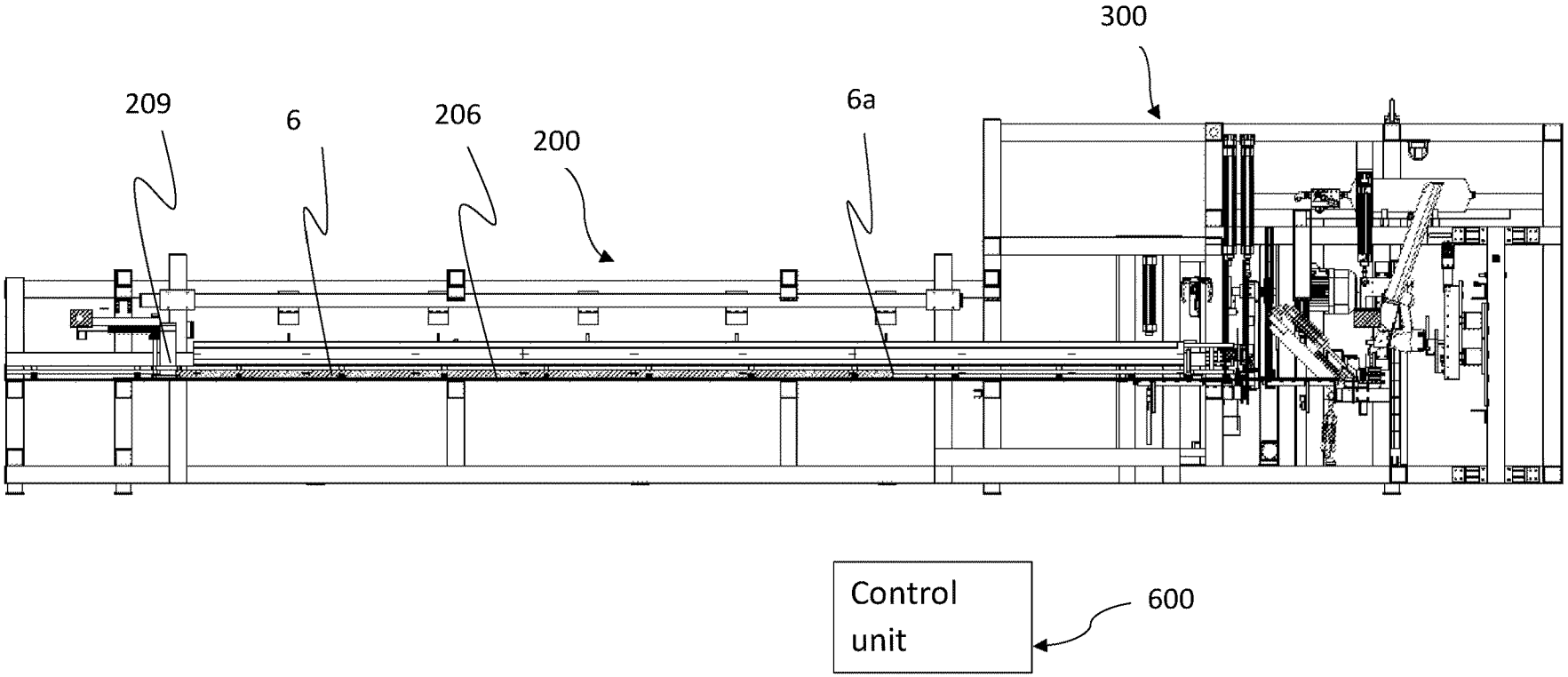
FIG. 6 discloses another view of the nogging material handling section with a schematic piece of nogging material.

Now turning to FIGS. 5 and 6 the skid rail 206 is supported by a frame 207. The skid rail 206 extends along the second direction B. As given above, the skid rail 206 is configured to receive one piece of overlong nogging material at the time from the sub-conveyors 203. The frame 207 further comprises a guiding rail 208 extending above and in parallel with the skid rail 206. The guiding rail 208 supports a gripper 209 configured to grip the free end of the nogging material (not disclosed).

Now turning to FIG. 6, the skid rail 206 supports a schematically illustrated piece of overlong nogging material 6 having a first free end 6*a* facing the cutting and fixation section 300 and a second free end gripped by the gripper 209. In this view, the protective walls protecting the cutting and fixation section 300 are removed. The gripper 209 is configured to be movable along the guiding rail 208 to thereby push the nogging material 6 along the skid rail 206. The displacement of the gripper 209 along the skid rail 206 may be controlled by the processor of the control unit 600 based on signals from sensors (not disclosed). The displacement is made to such extent that the free end of the overlong nogging material closely abuts a first longitudinal side surface of the stud that has been supplied to the cutting and fixation section 300 by the carrier 107 of the stud handling section 100. A cross section of the stud 2 is schematically illustrated in FIG. 7.

The guiding rail 208 and/or the skid rail 206 preferably comprises two or more sensors (not disclosed) configured to determine, by using the processor of the control unit 600, the remaining length of the overlong piece nogging material. The processor is configured to compare the determined remaining length with the length of a nogging 3*a*-3*c* to be cut and joined to the stud 2. If the remaining length is determined to be too short, a new piece of overlong nogging material should be provided to the skid rail 206 from the sub-conveyors 203 and replace the too short piece of nogging material.

Figure 7:
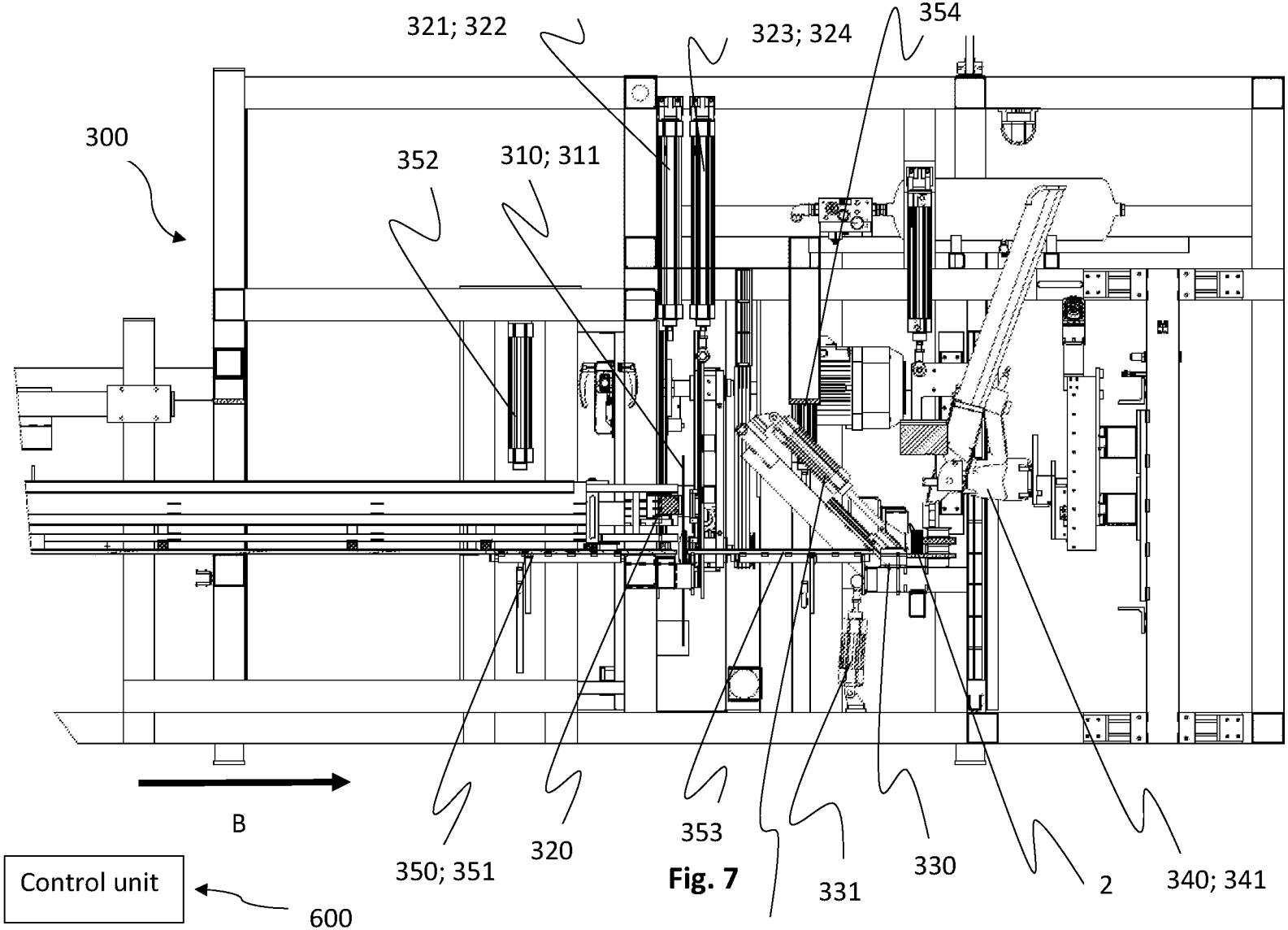
FIG. 7 discloses a view of the cutting and fixation section.

Now turning to FIG. 7, a side view of the cutting and fixation section 300 is disclosed. The cutting and fixation section 300 comprises a saw arrangement 310, a first gripper arrangement 320, a second gripper arrangement 330, a fixation arrangement 340, and a waste material handling arrangement 350.

The saw arrangement 310 comprises a saw 311. In the present embodiment the saw is a circular saw having its saw blade oriented in a direction transvers to the second direction B. It is to be understood that other types of saws are equally applicable.

The first gripper arrangement 320 is arranged adjacent the saw arrangement 310. The first gripper arrangement 320 comprises a first gripper 321 operated by a first cylinder 322 upstream the saw arrangement 310 and a second gripper 323 operated by a second cylinder 324 downstream the saw arrangement 310. The two grippers 321, 323 are configured to be operable to selectively engage the nogging material in order to hold the nogging material firmly before, during and after sawing. After sawing, the first gripper 321 arranged upstream the saw arrangement 310 is released, thereby loosening its engagement with the overlong piece of nogging material, while the second gripper 323 downstream the saw arrangement 310 maintains its engagement with the resulting cut nogging 3*a*-3*c*. The opposing free end of the nogging 3*a*-3*c* is arranged to closely abut the longitudinal side edge of the stud 2.

The saw arrangement 310 is configured to clean-cut the free end of the overlong piece of nogging material in case of a new piece of nogging material being moved towards the cutting and fixation section 300. After clean-cutting, the nogging material is configured to be displaced by the gripper 209 anew along the second direction B so that the clean-cut free end of the nogging material closely abuts the longitudinal side edge of the stud 2. In this position the saw arrangement 310 is configured to cut the overlong piece of nogging material to the desired length to thereby form a first nogging 3*a* having a desired length.

The thus formed first nogging 3*a* is configured to be gripped by the second gripper arrangement 330. In the disclosed embodiment, the second gripper arrangement 330 is operated by two cylinders 331; 332 acting on the nogging 3*a* and on the stud 2 respectively. The second gripper arrangement 330 is configured to hold the nogging 3*a* and the stud 2 in a fixed position with the free end of the nogging 3*a* closely abutting the longitudinal side surface of the stud 2. In this position, the fixation arrangement 340 is activated. The fixation arrangement 340 comprises in the disclosed embodiment a nailing machine 341 arranged on the opposite side of the stud 2. The nailing machine 341 is configured to arrange one or more nails from a second side surface of the stud, the second side surface being opposite the first side surface, through the stud 2 and into the nogging 3*a*, thereby joining the first nogging 3*a* to the stud 2. The nailing machine 341 may be movable in the vertical direction and in the disclosed embodiment it has been moved to a resting position in which its nailing head is off-set from the longitudinal centerline of the nogging material.

After joining, the second gripper arrangement 330 is configured to release its engagement with the nogging 3*a* and the stud 2 and the now formed sub-module (not disclosed) is configured to be displaced by the carrier 107 of the stud handling section 100 a distance along the first direction A corresponding to the center distance C-C of two adjacent noggings 3*a*-3*c* of the sub-module to be formed.

The overlong piece of nogging material, now having a cut free end, is configured to be displaced anew by the gripper 209 along the skid rail 206 in the second direction B into a position in which the cut free end of the overlong piece of nogging material closely abuts the longitudinal side surface of the stud 2. In this position, the first gripping arrangement 320 and the saw arrangement 310 are configured to be activated anew to engage the piece of overlong nogging material while cutting the nogging material to form a new, second nogging 3*b*.

The stud 2 and the second nogging 3*b* are configured to be gripped anew by the second gripper arrangement 330 to hold the second nogging 3*b* in a fixed position with its free end closely abutting the longitudinal side surface of the stud 2. In this position, the fixation arrangement 340 is configured to be activated anew to join the second nogging 3*b* to the longitudinal side surface of the stud 2 by one or more nails.

Providing the sub-module 1 to be produced is configured to have more than two noggings 3*a*, 3*b*, the stud 2, now supporting two noggings, is anew displaced by the carrier 107 of the stud handling section 100 a distance along the first direction A corresponding to the center distance C-C of two adjacent noggings 3*a*-3*c* of the sub-module 1 to be formed. The process described above is repeated until the correct number of noggings 3*a*-3*c* have been joined to the stud 2.

Providing the sub-module 1 to be produced is designed to have no more noggings, the finished sub-module 1 is transferred by the carrier 107 along the first direction A to the sub-module handling section 500, see FIG. 2. The sub-module handling system 500 is in the disclosed embodiment provided as a conveyor 501 configured to transfer the sub-module 1 away from the system 10 for further handling. The carrier 107 is configured to be returned along the guiding rail 208 and a new stud 2 may be transferred to the skid rail 106 of the stud handling section 100.

Before each displacement of the overlong piece of nogging material towards the stud 2, the control unit 600 is configured to determine, based on input from sensors (not disclosed) that are distributed along the skid rail 206, if the remaining length of the overlong piece of nogging material is sufficient to form a nogging 3*a*-3*c* of a desired length. If determined by the control unit 600 that the remaining length is too small, the nogging material is removed from the skid rail 206 via a waste material handling arrangement 350.

In the disclosed embodiment the removal is made via a first shutter 351 arranged in the bottom of the skid rail 209 in a position upstream the saw arrangement 300. The first shutter 351 is operable by a cylinder 352 which is configured to open and close said shutter 351.

Further, to remove waste material resulting from the clean-cutting of the free end of the overlong nogging material, a second shutter 353 is arranged in the bottom of the skid rail 206 in a position downstream the saw arrangement 300. The second shutter 353 is operable by a cylinder 354 which is configured to open and close said shutter 353.

The removed waste material is in the disclosed embodiment of the system 10 collected on a conveyor 401, see FIG. 2 forming part of the waste handling section 400. The waste material may be collected in a container 402 for recycling.

Figure 8:
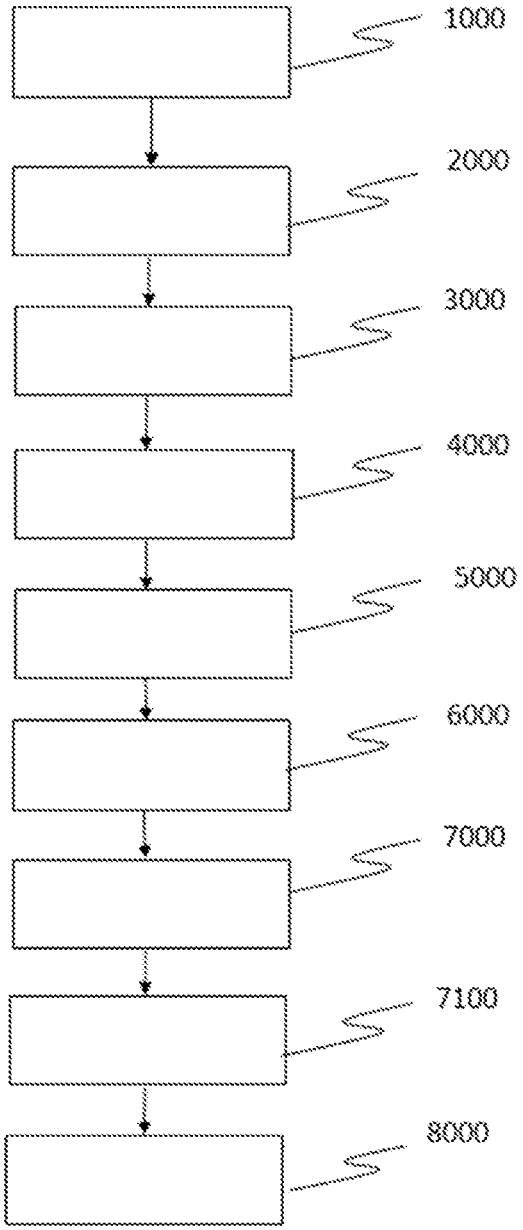
FIG. 8 is a flow chart disclosing the acts of the method of joining a nogging to a stud to form a sub-module of a prefabricated building module.

Now turning to FIG. 8, the method of joining a nogging 3*a*-3*c* to a stud 2 to form a sub-module 1 of a prefabricated building module may be described by the following acts.

Providing 1000 a stud 2 and orienting the stud 2 with a longitudinal extension of the stud 2 along the first direction A. The stud has a pre-cut length with its opposing free ends clean-cut. Also, the stud 2 is preferably oriented with its crowning in a predetermined orientation.

The stud 2 is displaced by the carrier 107 in the longitudinal direction into the cutting and fixation section 300. The stud 2 is moved to such position that the intended position for a first nogging 3*a* to be joined to the stud 2 is aligned with the longitudinal center line of an overlong piece of nogging material that is to be provided on the skid rail 206 of the nogging material handling section 200.

Providing 2000 an overlong piece of nogging material having a longitudinal extension being greater than an intended length of the nogging 3*a*-3*c*, and orienting the overlong piece of nogging material with its longitudinal extension along the second direction B being transverse to the first direction A.

Moving 3000 the first free end of the overlong piece of nogging material into abutment with a first side surface of the stud 2. The overlong piece of nogging material is supported by the skid rail 206 and moved along the same in the second direction B by the gripper 209 engaging the second free end of the nogging material. The first free end of the overlong piece of nogging material is preferably clean-cut before moving the first free end of the nogging material into abutment with the first side surface of the stud 2.

Cutting 4000 the overlong piece of nogging material at a distance from the abutment with the stud 2, thereby forming a first nogging 3*a* having an intended length.

Fixating 5000 the stud 2 and the first nogging 3*a* and joining the end of the nogging 3*a* with the side surface of the stud 2 by at least one fixing member, such as a nail, from a second side surface of the stud 2, the second side surface being opposite the first side surface. The joining is preferably made by using a nailing machine 341. The number of fixing members to be arranged depends on the cross sectional dimensions of the nogging 3*a*-3*c*. Before and during the insertion of the fixation member, the stud 2 and the nogging 3*a*-3*c* are fixated by the second gripper arrangement 330 to maintain the relative position.

After fixation, the stud 2 and the first nogging 3*a* fixated thereto are moved 6000 along the first direction A. The moving is made by the carrier 107 of the stud handling section 100 which displaces the sub-module comprising the stud 2 and the single nogging 3*a* a distance along the first direction A corresponding to the center distance C-C of two adjacent noggings 3*a*-3*c* of the sub-module 1 to be formed.

Moving 7000 the free end of the remaining overlong piece of nogging material into abutment with the first side surface of the stud 2. The moving 7000 is made by the gripper 209 of the nogging material handling section 200 being displaced along the skid rail 206. During this movement, sensors (not disclosed) that are arranged along the skid rail 206 communicate with the control unit 600 which processes the information to determine 7100 if the remaining length of the overlong piece of nogging material is sufficient to form yet another nogging 3*a*-3*c*.

If it is determined 7100 by the control unit 600 that the remaining length of the nogging material is smaller than the intended length of the nogging 3*a*-3*c* to be cut, the nogging material is removed. The removal is made by opening the first shutter 351 upstream the saw arrangement 300 and letting the gripper 209 release its engagement with the nogging material. The released nogging material will fall down by gravity to the conveyor 401 that runs below the nogging material handling section 200.

If the control unit 600 determines that the remaining length of the overlong nogging material is sufficient, the nogging material is cut 8000 anew thereby forming a second nogging 3*b* having the intended length.

The free end of the thus cut second nogging 3*b* is joined 9000 to the side surface of the stud 2 by inserting at least one second fixing member from the second side surface of the stud 2. Before and during the insertion of the second fixation member, the stud 2 and the second nogging 3*b* are fixated by the second gripping arrangement 330 to maintain the relative position.

At least one of the steps of: moving 6000 the stud 2 and the first nogging 3*a* along the first direction A, thereby providing a mutual distance between the first and the second noggings 3*b*; and forming 4000, 8000 the first and the second noggings 3*a*, 3*b* respectively with an intended length may be performed based on geometrical input data provided from a CAD model representing a building module in which the stud and the first and the second noggings 3*b* are forming parts. The geometrical input data is transferred to the control unit 600 configured to control the method.

It is to be understood that the structural design of the machinery system to perform the method may be changed in a number of ways within the scope of the claims. It is to be understood that one or more control units may be configured to control the operation of the system and the method.

The invention claimed is:

1. Method of joining a nogging to a stud to form a sub-module of a prefabricated building module, the method comprising the steps of:

providing a stud and orienting the stud with a longitudinal extension of the stud along a first direction;

providing a nogging material having a longitudinal extension being greater than an intended length of the nogging, and orienting the nogging material with a longitudinal extension along a second direction being transverse to the first direction;

moving a first free end of the nogging material into abutment with a first side surface of the stud;

cutting the nogging material at a distance from the abutment, thereby forming a first nogging having an intended length;

fixating the stud and the first nogging and joining the free end of the nogging with the side surface of the stud by inserting a fixing member from a second side surface of the stud, the second side surface being opposite the first side surface;

moving the stud and the first nogging along the first direction; and moving the free end of the nogging material into abutment with the first side surface of the stud;

cutting the nogging material at a distance from the abutment, thereby forming a second nogging having the intended length; and fixating the stud and the second nogging and joining the free end of the second nogging with the side surface of the stud by inserting a second fixing member from the second side surface of the stud.

2. Method of claim 1, further comprising the steps of determining the remaining length of the nogging material, and if determined to be smaller than the intended length of the nogging to be cut, removing the nogging material.

3. Method of claim 1, wherein the free end of the nogging material is clean cut before moving the free end of the nogging material into abutment with the first side surface of the stud.

4. Method according to claim 1, wherein the stud is provided with a predetermined length and with its opposing free ends clean-cut.

5. Method according to claim 1, wherein the nogging material is supported and moved along the second direction by a gripper engaging a second free end of the nogging material.

6. Method of claim 1, wherein at least one of the steps of:

moving the stud and the first nogging along the first direction, thereby providing a mutual distance between the first and the second noggings, and forming the first and the second noggings respectively with an intended length are performed based on geometrical input data provided from a CAD model representing a building module in which the stud and the first and the second noggings are forming parts, which geometrical input data is transferred to a control computer configured to control the method.

* * * * *